US009933223B2

(12) United States Patent
Latka

(10) Patent No.: US 9,933,223 B2
(45) Date of Patent: Apr. 3, 2018

(54) COVER SYSTEM FOR SOUND SUPPRESSOR

(71) Applicant: GSL TECHNOLOGY, INC., Jackson, MI (US)

(72) Inventor: Gregory S. Latka, Jackson, MI (US)

(73) Assignee: GSL Technology, Inc., Jackson, MI (US)

( * ) Notice: Subject to any disclaimer, the term of this patent is extended or adjusted under 35 U.S.C. 154(b) by 6 days.

(21) Appl. No.: 15/214,716

(22) Filed: Jul. 20, 2016

(65) Prior Publication Data

US 2018/0023914 A1 Jan. 25, 2018

(51) Int. Cl.

| | |
|---|---|
| ***F41A 21/34*** | (2006.01) |
| ***F41A 21/30*** | (2006.01) |
| ***F41H 3/02*** | (2006.01) |
| ***F41A 21/44*** | (2006.01) |

(52) U.S. Cl.
CPC ..... *F41A 21/30* (2013.01); *F41A 21/44* (2013.01); *F41H 3/02* (2013.01)

(58) Field of Classification Search
CPC ..... F41A 21/30
USPC ..... 42/96, 90; 89/14.4; 181/198, 217, 223
See application file for complete search history.

(56) References Cited

U.S. PATENT DOCUMENTS

| | | | | |
|---|---|---|---|---|
| 1,462,158 | A | 3/1922 | Wildner | |
| 4,716,809 | A | 1/1988 | A'Costa | |
| 5,029,512 | A | 7/1991 | Latka | |
| 5,559,302 | A | 9/1996 | Latka | |
| 5,685,102 | A | 11/1997 | Latka | |
| 7,412,917 | B2 | 8/2008 | Vais | |
| 7,832,323 | B1 * | 11/2010 | Davies | F41A 21/30 89/14.4 |
| D632,751 | S | 2/2011 | Bowers et al. | |
| 8,196,701 | B1 | 6/2012 | Oliver | |
| 8,210,087 | B2 | 7/2012 | Latka | |
| 8,397,615 | B2 | 3/2013 | Poling | |
| 8,844,422 | B1 | 9/2014 | Klett | |
| 8,910,745 | B2 | 12/2014 | Latka | |
| 8,991,551 | B2 | 3/2015 | Latka | |
| 8,991,552 | B2 | 3/2015 | Latka | |
| 9,086,248 | B2 | 7/2015 | Latka | |
| 2008/0148928 | A1 | 6/2008 | McClellan | |
| 2011/0220434 | A1 * | 9/2011 | Silvers | F41A 21/30 181/223 |
| 2013/0340313 | A1 | 12/2013 | Myers et al. | |
| 2014/0059913 | A1 | 3/2014 | Diamond et al. | |

* cited by examiner

*Primary Examiner* — John W Eldred
(74) *Attorney, Agent, or Firm* — Young Basile Hanlon & MacFarlane, P.C.

(57) ABSTRACT

A cover system for a sound suppressor that reduces the mirage created by the heat generated when a projectile is fired through the sound suppressor and allows the sound suppressor's appearance to be easily changed to blend in with the sound suppressor's surroundings. The cover system comprises a front cap and a cylindrical member. The front cap is configured for attachment to the cylindrical member. The cylindrical member is configured for attachment to the front cap and to receive the sound suppressor. An air gap is formed between an outer surface of the sound suppressor and an inner surface of the cylindrical member when the sound suppressor is at least partially received within the cylindrical member.

20 Claims, 2 Drawing Sheets

COVER SYSTEM FOR SOUND SUPPRESSOR

TECHNICAL FIELD

This disclosure relates generally to sound suppressors for firearms, and more particularly to cover systems for sound suppressors that reduce the mirage created by the heat and allow the user to easily change the appearance of the sound suppressor.

BACKGROUND

Sound suppressors absorb and reduce audible frequencies and vibrations that result from the rapid expansion of gases leaving the muzzle of a firearm as a projectile exits the firearm. This is accomplished by temporarily containing and diverting the rapidly expanding gases and other combustion by-products that are emitted from the muzzle of the firearm in inner chambers of the sound suppressor. Heat is generated as a result of this process, which in turn creates a mirage effect that disrupts the sight picture.

Additionally, sound suppressors are typically a solid color, such as black or tan. This greatly hampers the sound suppressor's ability to blend in with its surroundings. Cloth sleeves can be used to cover the exterior of a sound suppressor with a camouflage or decorative pattern. However, there are numerous disadvantages to using a cloth sleeve because of the heat generated when a projectile is fired through the sound suppressor.

SUMMARY

Disclosed herein are cover systems for sound suppressors of firearms. According to a first embodiment, a cover system for a sound suppressor for a firearm comprising a front cap and a cylindrical member. The front cap is configured for attachment to the cylindrical member. The cylindrical member is configured for attachment to the front cap and to receive the sound suppressor. An air gap is formed between an outer surface of the sound suppressor and an inner surface of the cylindrical member when the sound suppressor is at least partially received within the cylindrical member.

According to a second embodiment, a cover system for a sound suppressor comprising a front cap and an elongated cylindrical member. The front cap has a substantially tubular configuration with a bore extending from a first end to a second end. A first shoulder is formed on an inner surface of the front cap. A second shoulder is formed on an outer surface of the front cap. Threading is formed on the outer surface near the second end of the front cap. The elongated cylindrical member has a substantially tubular configuration with a bore extending from a first end to a second end. Threading is formed on an inner surface of the elongated cylindrical member near the first end. The first end of the elongated cylindrical member abuts the second shoulder of the front cap when the threading on the first end of the elongated cylindrical member engages the threading on the outer surface of the front cap.

According to a third embodiment, an apparatus comprising a sound suppressor, a front cap, a cylindrical member, and an end cap. The sound suppressor has a bore extending longitudinally from a first end to a second end. The front cap has a bore extending longitudinally from a first end to a second end. The cylindrical member having a bore extending longitudinally from a first end to a second end. The bore of the cylindrical member defined by an inner surface. The end cap has a bore extending therethrough. The sound suppressor is at least partially retained within the bore of the cylindrical member by the front cap and the end cap. The bore of the front cap, the bore of the sound suppressor, and the bore of the end cap are in communication with one another. An air gap is formed between the inner surface of the cylindrical member and an outer surface of the sound suppressor.

These and other aspects of the present disclosure are disclosed in the following detailed description of the embodiments, the appended claims and the accompanying figures.

BRIEF DESCRIPTION OF THE DRAWINGS

The invention is best understood from the following detailed description when read in conjunction with the accompanying drawings. It is emphasized that, according to common practice, the various features of the drawings are not to-scale. On the contrary, the dimensions of the various features may be arbitrarily expanded or reduced for clarity.

DETAILED DESCRIPTION

Figure 1:
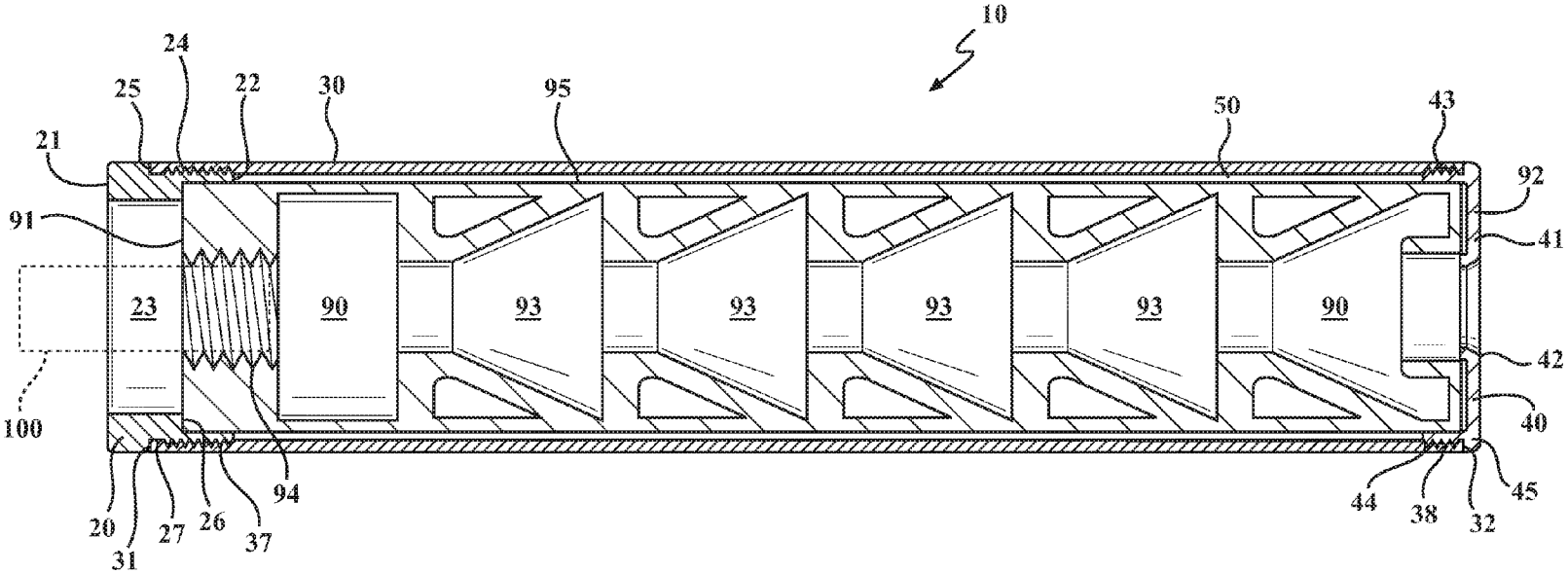
FIG. 1 is a cross-sectional view of a cover system with a sound suppressor.
Figure 2:
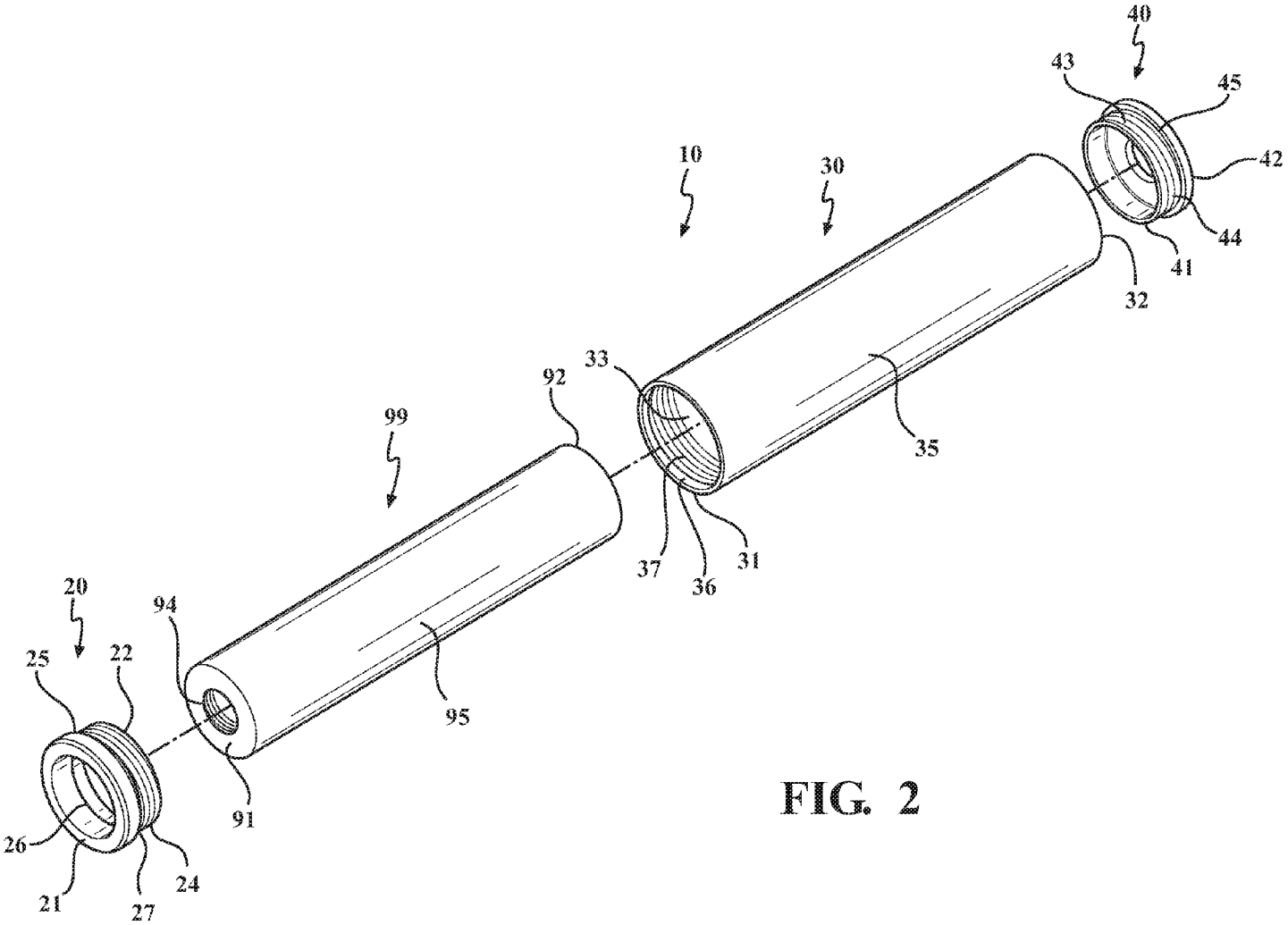
FIG. 2 is an exploded perspective view of the cover system with the sound suppressor.

A cover system 10 for a sound suppressor 99 is illustrated in FIGS. 1-2. The cover system 10 helps reduce the mirage created by the heat generated when a projectile is fired through the firearm, while also allowing a user to easily change the appearance of the sound suppressor 99. For example, the user could change the cosmetic appearance of the sound suppressor 99 to reflect a camouflage pattern that closely matches the environment in which the sound suppressor 99 is used within.

An example of the cover system 10 in use with the sound suppressor 99 is illustrated in FIG. 1. The exemplar sound suppressor 99 has a substantially cylindrical configuration with a bore 90 extending from a first end 91 to a second end 92. The bore 90 is large enough that a projectile can travel through the sound suppressor 99 from the first end 91 to the second end 92 without interference. Within the sound suppressor 99, baffles or internal chambers 93 are formed within the bore 90 to attenuate and capture the flow of combustion gases associated with firing a projectile through the sound suppressor 99. An outer surface 95 of the sound suppressor 99 extends continuously from the first end 91 to the second end 92 so that the combustion gases are contained within the bore 90 and can only escape after flowing through each of the internal chambers 93 and reaching the second end 92 of the sound suppressor 99. The first end 91 can be configured for attachment to an end 100 of a firearm, such as having threading formed on an internal or external surface. In the illustrated, non-limiting example, screw thread 94 is formed on an internal surface defined by the bore 90 near the first end 91 of the sound suppressor 99.

The cover system 10 is comprised of a front cap 20, an elongated cylindrical member 30, and an end cap 40. The front cap 20, the elongated cylindrical member 30, and an end cap 40 can be made from a hard material having thermodynamic properties, such as aluminum. The front cap 20 can have a substantially tubular configuration with a bore 23 extending from a first end 21 to a second end 22. The bore 23 can have a diameter that is large enough to accommodate a projectile or the end 100 of a firearm. Screw thread 24 can be formed on an outer surface 27 of the front cap 20 near the second end 22. The outer surface 27 can display a camouflage pattern or other decorative touches. A first shoulder 25 can be formed in the outer surface 27 between the first end 21 and the second end 22. A second shoulder 26 can be formed in an inner surface that defines the bore 23 between the first end 21 and the second end 22. As illustrated, the first shoulder 25 of the front cap 20 is closer to the first end 21 than the second shoulder 26 of the front cap 20, and the second shoulder 26 of the front cap 20 is closer to the second end 22 than the first shoulder 25 of the front cap 20.

The elongated cylindrical member 30 also has a substantially tubular configuration with a bore 33 extending from a first end 31 to a second end 32. The elongated cylindrical member 30 can be substantially solid longitudinally from the first end 31 to the second end 32 and radially from an outer surface 35 to an inner surface 36 that defines the bore 33. The outer surface 35 can display a camouflage pattern or other decorative touches. Screw thread 37, 38 can be formed on the inner surface of the elongated cylindrical member 30. Screw thread 37 is near the first end 31 of the elongated cylindrical member 30 and is complementary to screw thread 24 of the front cap 20. Screw thread 38 is near the second end 32 of the elongated cylindrical member 30.

So that the cover system 10 can accommodate the sound suppressor 99, the elongated cylindrical member 30 can have a length that is approximately the same or slightly longer as the length of the sound suppressor 99. It is anticipated that the elongated cylindrical member could also have a length that is slightly shorter than the length of the sound suppressor 99 or that the elongated cylindrical member 30 could be substantially longer or shorter than the sound suppressor 99. The bore 33 of the elongated cylindrical member 30 can also have a diameter that is slightly larger than the diameter of the outer surface 95 of the sound suppressor 99. By having a larger diameter, the sound suppressor 99 can be housed within the bore 33 of the elongated cylindrical member and an air gap 50 is formed between the outer surface 95 of the sound suppressor 99 and the inner surface 36 of the elongated cylindrical member 30. Fluid communication does not occur between the air gap 50 and the combustion gases contained within the bore 90 of the sound suppressor 99.

A body 41 of the end cap 40 can have a substantially disc-like configuration with a bore 42 extending through the center of the body 41. The bore 42 can have a cylindrical configuration and be sized to accommodate a projectile that is fired through the sound suppressor 99. Near the outer circumference of the body 41, a radial wall 43 extends substantially perpendicular from the body 41 of the end cap 40. Screw thread 44 can be provided on an outer surface of the radial wall 43 that is complementary to screw thread 38 of the elongated cylindrical member 30. A shoulder 45 can be formed on the outer circumference of the body 41 where the radial wall 43 abuts the body 41 of the end cap 40. The radial wall 43 can have a diameter that is slightly smaller than the diameter of the inner surface 36 of the elongated cylindrical member 30 so that the radial wall 43 fits within the bore 33 of the elongated cylindrical member 30 with the second end 32 of the elongated cylindrical member 30 abutting the shoulder 45 of the end cap 40.

To assemble and use the cover system 10, the first end 21 of the front cap 20 is slide over the end 100 of the firearm. The first end 91 of the sound suppressor 99 is then inserted into the bore 23 of the front cap 20 so that the first end 91 of the sound suppressor 99 abuts the second shoulder 26 of the front cap 20. The sound suppressor 99 can be attached to the firearm by engaging the end 100 of the firearm with screw thread 94 of the sound suppressor 99. The elongated cylindrical member 30 can then be slide over the sound suppressor 99 until the first end 31 of the elongated cylindrical member 30 abuts the first should 25 of the front cap. The elongated cylindrical member 30 can be secured to the front cap 20 by engaging screw thread 37 of the elongated cylindrical member 30 with screw thread 24 of the front cap 20. The air gap 50 will be formed between the outer surface 95 of the sound suppressor 99 and the inner surface 36 of the elongated cylindrical member 30. The end cap 40 can then be added by inserting the radial wall 43 of the end cap 40 between the outer surface 95 of the sound suppressor 99 and the inner surface 36 of the elongated cylindrical member 30. The second end 32 of the elongated cylindrical member 30 can abut the shoulder 45 of the end cap 40. The end cap 40 can be secured to the elongated cylindrical member 30 by engaging screw thread 44 of the end cap 40 with screw thread 38 of the elongated cylindrical member 30.

When a projectile is fired from the firearm, it will travel through the cover system 10 and the sound suppressor 99. The cover system 10 helps reduce the mirage that results from the heat generated when the projectile is fired through the sound suppressor 99. The cover system 10 also changes the cosmetic appearance of the sound suppressor 99 if a camouflage pattern or other decorative touches are provided on the front cap 20 and/or the elongated cylindrical member 30.

To dissemble the cover system 10, the end cap 40 can be disconnected, if present, by disengaging screw thread 44 of the end cap 40 from screw thread 38 of the elongated cylindrical member 30. The elongated cylindrical member 30 can be disconnected by disengaging screw thread 37 of the elongated cylindrical member 30 from screw thread 24 of the front cap 20. The elongated cylindrical member 30 can then be disconnected from the front cap 20. The front cap 20 can then be removed from the end 100 of the firearm.

While the invention has been described in connection with certain embodiments, it is to be understood that the invention is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A cover system for a sound suppressor having a substantially cylindrical body, an outer surface that is continuous, and a bore comprising:

a front cap configured for attachment to a cylindrical member; and the cylindrical member configured for attachment to the front cap and to removably receive the sound suppressor, wherein an air gap is formed between the outer surface of the sound suppressor and an inner surface of the cylindrical member when the sound suppressor is received within the cylindrical member and wherein the air gap is not in fluid communication with the bore of the sound suppressor.

2. The cover system of claim 1, wherein the front cap provides threading on a surface that matingly engages complementary threading on the cylindrical member.

3. A cover system for a sound suppressor having a substantially tubular body, a primary end, an integral outer surface, and a bore extending longitudinally from the primary end comprising:

a front cap having a substantially tubular configuration with a bore extending from a first end to a second end, wherein a first shoulder is formed on an inner surface of the front cap, a second shoulder is formed on an outer surface of the front cap, and threading is formed on the outer surface near the second end of the front cap; and an elongated cylindrical member having a substantially tubular configuration with a bore extending from a first end to a second end, wherein threading is formed on an inner surface near the first end, wherein the first end of the elongated cylindrical member abuts the second shoulder of the front cap when the threading on the first end of the elongated cylindrical member engages the threading on the outer surface of the front cap, and wherein the sound suppressor is removably housed within the elongated cylindrical member.

4. The cover system of claim 3, wherein the elongated cylindrical member is made from aluminum.

5. The cover system of claim 3, further comprising:

an end cap having a body and a radial wall extending from the body, wherein a shoulder is formed between the radial wall and an outer circumference of the body.

6. The cover system of claim 5, wherein the second end of the elongated cylindrical member engages the shoulder of the end cap when the radial wall is inserted into the bore of the elongated cylindrical member.

7. The cover system of claim 5, wherein threading is provided on an outer surface of the radial wall of the end cap.

8. The cover system of claim 7, wherein the threading on the end cap engages threading near the second end of the elongated cylindrical member when the radial wall of the end cap is inserted into the bore of the elongated cylindrical member.

9. The cover system of claim 3, wherein the first end of the sound suppressor abuts the first shoulder of the front cap creating an air gap between the outer surface of the sound suppressor and an inner surface of the elongated cylindrical member when the sound suppressor is removably housed within the elongated cylindrical member, and wherein the air gap is not in fluid communication with the bore of the sound suppressor.

10. The cover system of claim 5, wherein the bore of the front cap, the bore of the elongated cylindrical member, and the bore of the end cap are in communication with one another.

11. The cover system of claim 3, wherein the elongated cylindrical member has a longitudinal length that is substantially the same as a longitudinal length of the sound suppressor.

12. The cover system of claim 3, wherein a camouflage pattern is provided on an outer surface of the elongated cylindrical member.

13. An apparatus comprising:

a sound suppressor having a substantially cylindrical configuration with an integral outer surface and a bore extending longitudinally from a first end to a second end;

a front cap having a bore extending longitudinally from a first end to a second end;

a cylindrical member having a bore extending longitudinally from a first end to a second end, the bore of the cylindrical member defined by an inner surface; and an end cap having a bore extending therethrough, wherein the sound suppressor is removably retained within the bore of the cylindrical member by the front cap and the end cap, wherein the bore of the front cap, the bore of the sound suppressor, and the bore of the end cap are in communication with one another, and wherein an air gap is formed between the inner surface of the cylindrical member and an outer surface of the sound suppressor.

14. The apparatus of claim 13, wherein an outer surface of the cylindrical member is provided with a camouflage pattern.

15. The apparatus of claim 13, wherein the air gap and the bore of the sound suppressor are not in fluid communication.

16. The apparatus of claim 13, wherein the front cap further comprises a shoulder formed on an inner surface, and wherein the first end of the sound suppressor abuts the shoulder of the front cap.

17. The apparatus of claim 13, wherein the front cap further comprises a shoulder formed on an outer surface, and wherein the first end of the cylindrical member abuts the shoulder of the front cap.

18. The cover system of claim 13, wherein the elongated cylindrical member has a longitudinal length that is substantially the same as a longitudinal length of the sound suppressor.

19. The apparatus of claim 13, wherein the end cap further comprises a radial wall, and wherein the radial wall of the end cap engages the inner surface of the cylindrical member.

20. The apparatus of claim 19, wherein the end cap further comprises a shoulder formed between the radial wall and an outer circumference, and wherein the second end of the cylindrical member abuts the shoulder of the end cap.

* * * * *